United States Patent [19]

Vandeweghe

[11] 4,074,225

[45] Feb. 14, 1978

[54] EMERGENCY DETECTION ALARM AND EVACUATION SYSTEM

[75] Inventor: Joseph L. Vandeweghe, Englewood, N.J.

[73] Assignee: Engleway Corporation, Englewood, N.J.

[21] Appl. No.: 576,034

[22] Filed: May 9, 1975

[51] Int. Cl.[2] ..... G08B 21/00

[52] U.S. Cl. ..... 340/237 R; 340/227 R; 340/329; 358/108

[58] Field of Search ..... 340/237 S, 227 R, 371, 340/332; 182/18, 48

[56] References Cited

U.S. PATENT DOCUMENTS

| | | | |
|---|---|---|---|
| 2,085,807 | 7/1937 | Lindsey | 340/227.1 X |
| 3,634,846 | 1/1972 | Fogiel | 340/221 |
| 3,916,404 | 10/1975 | Gouge | 340/371 |

*Primary Examiner*—Thomas B. Habecker
*Attorney, Agent, or Firm*—Bernard Malina

[57] ABSTRACT

An emergency detection alarm and evacuation system adapted for use in a multi-storied building comprises a plurality of spatially distributed fire/smoke detectors and a plurality of exit signalling units respectively located adjacent the emergency exit doors on each building floor. A control panel on the lobby floor of the building includes lighted indicators which respectively indicate the actuation of particular fire/smoke detectors and lighted pushbutton switches operative to selectively actuate specific signalling units to thereby direct the building occupants to particular exit doors. Also disclosed is a closed circuit television system for visually monitoring the fire/smoke conditions in particular floor areas, for use in conjunction with said exit signalling units.

7 Claims, 7 Drawing Figures

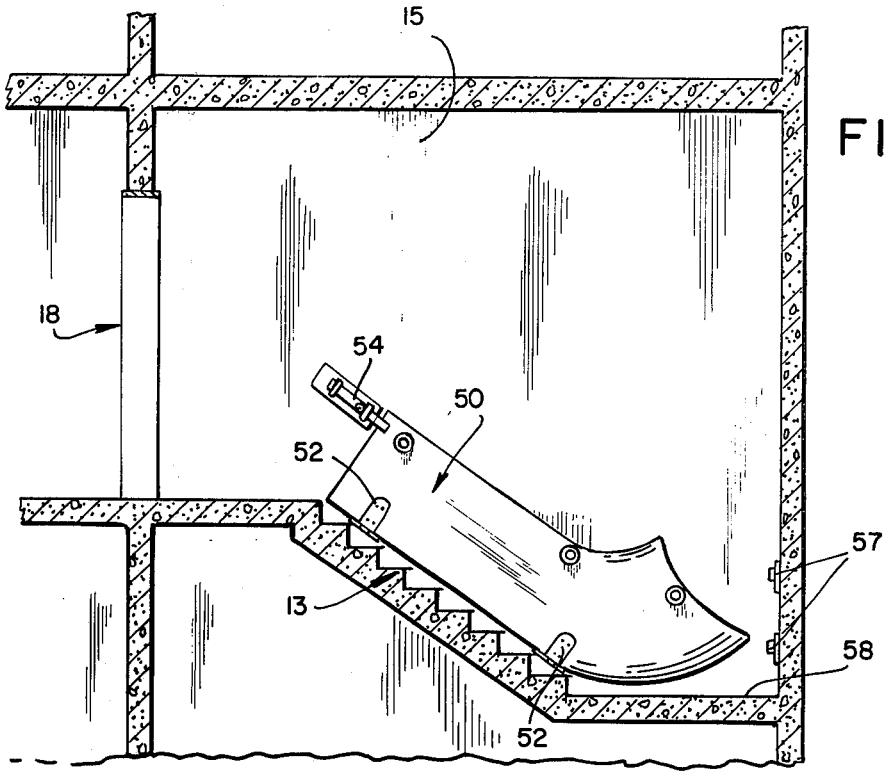
FIG. 5A
FIG. 5B
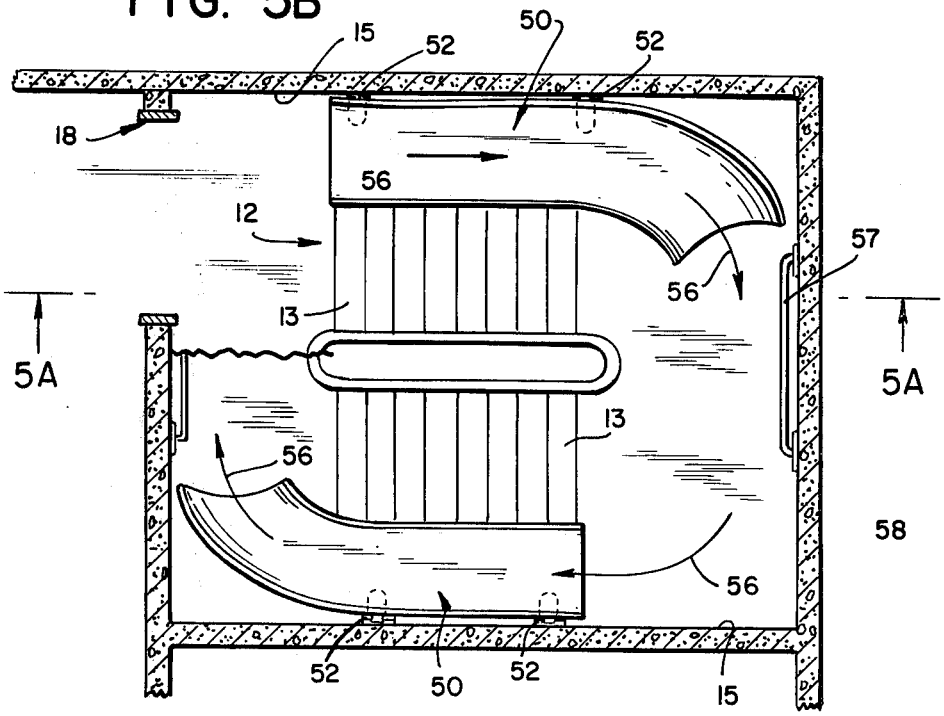

EMERGENCY DETECTION ALARM AND EVACUATION SYSTEM

BACKGROUND OF THE INVENTION

The present invention relates to emergency alert systems and more particularly to emergency alert and building occupant evacuation control systems.

The problem of alerting building occupants as to the existence of an emergency condition, such as a fire, explosion or the like and effecting a quick and orderly evacuation of the building occupants has been a long standing one. For example, many building occupants learn of the existence of a fire and/or smoke condition on the premises only when they hear a fire alarm bell or actually see or smell smoke or are advised thereof by word of mouth. When so advised, they normally try to seek out the closest fire exit door and try to leave the affected area or building through such exits. Unfortunately, the delay in learning of the emergency condition can seriously jeopardize their prospects for safe evacuation of the building premises.

Virtually all buildings are provided with signs indicating the location of door exits to be used by the building occupants in the event of fire or other emergency requiring prompt evacuation of the building premises. Such exit signs usually take the form of a flat rectangular sign bearing the word EXIT, or an illuminated box-like sign with EXIT on the front face thereof. Such signs are usually affixed to the building wall directly above the doorway intended to serve as the emergency exit.

The occurrence of a fire in the building is generally accompanied by smoke rapidly filling the affected areas which makes it very difficult, if not impossible, for the room occupants to see such conventional exit signs even if they are illuminated by ordinary lighting means such as by an incandescent light bulbs, particularly since such signs are usually located near the ceiling where the smoke is densest. Furthermore, it has been found that because they cannot see about them, the occupants of such a smoke filled room tend to lose their sense of orientation or direction and thus unable, by their own efforts, to find the fire exits, even if they remember their location. In addition, the emotional stress and sense of shock, excitement and possibly panic which generally afflicts persons suddenly finding themselves subject to a dire emergency such as a fire, further inhibits their ability to navigate their way to the fire exits, particularly where they must navigate through winding corridors to reach the fire exits.

It should be further noted that in many instances it is undesirable and even very dangerous for the building occupants to choose a particular fire exit as an escape route since such route may lead them into the path of the fire and smoke or other danger such as collapse of portions of the building structure. Thus, if a building floor has first and second fire exits at opposite sides of the floor leading respectively to their adjacent stairwells and if the fire danger is more severe in the area adjacent the fire exit, it is obviously essential that the occupants avoid the first fire exit at all and use the second fire exit. Clearly, in times of emotional stress and loss of directional orientation and visibility which are characteristic of emergency situations such as fires the occupants cannot be relied upon to make the proper decisions as to choice of appropriate fire exit. Thus, it has been found that in such cases the occupants often choose a particular exit door merely because others before them have chosen that exit, thus creating a stampede situation.

The foregoing emergency signalling and evacuation problems are greatly aggravated in the case of high-rise buildings, both commerical and residential, particularly office buildings which may have tens of thousands of occupants and where quick, safe and orderly evacuation of the building premises is virtually impossible by conventional means.

It is therefore an object of the present invention to provide hazardous condition detection, signalling and evacuation control system which is operative to safely evacuate the occupants from a given area in the event of such hazardous condition.

It is a further object of the present invention to provide a fire signalling and evacuation control system of the character described which is operative to detect the occurrence of a fire and/or smoke in a room or building, to alert the building occupants thereof and to direct the evacuation of the occupants through the appropriate exit routes.

SUMMARY OF THE INVENTION

In accordance with the principles of the present invention, there is provided an emergency detection and evacuation system comprising a plurality of detectors operative to detect and monitor an emergency condition and a plurality of emergency signalling units respectively located adjacent emergency exits. There is further provided a control panel comprising a plurality of indicators respectively connected to said emergency condition detectors and a plurality of switches respectively connected to said signalling units. The detectors are operative to respectively actuate the corresponding panel indicators upon occurrence of an emergency condition in the vicinity of a detector and the panel switches are operative to respectively actuate the corresponding signalling units.

Further objects, features and advantages of this invention will become apparent from a consideration of the following description, the appended claims and the accompanying drawings in which:

BRIEF DESCRIPTION OF THE DRAWINGS

FIG. 5A is a elevation view of a emergency exit staircase provided with a emergency evacuation chute in the retracted condition in accordance with the principles of the present invention;

FIG. 5B is a plan view of the staircase of FIG. 5A with the evacuation chute in the operative condition.

DETAILED DESCRIPTION OF THE INVENTION

Figure 1:
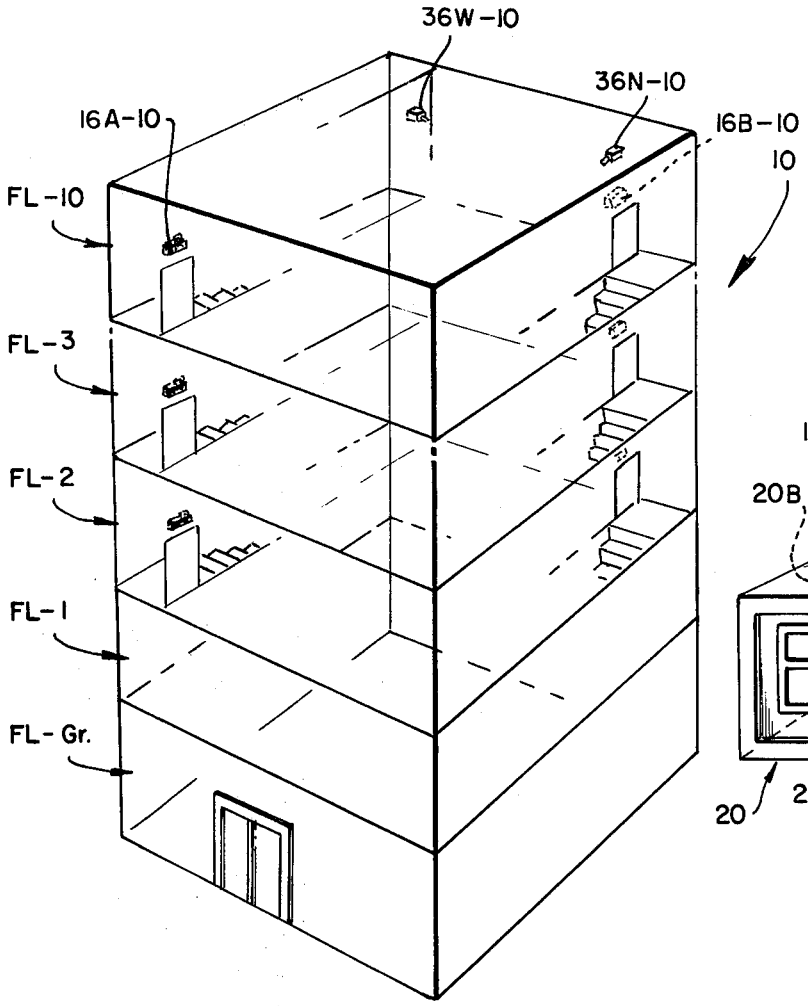
FIG. 1 is a perspective view of a multi-storied building equipped with the emergency detection and evacuation system of the present invention.
Figure 3:
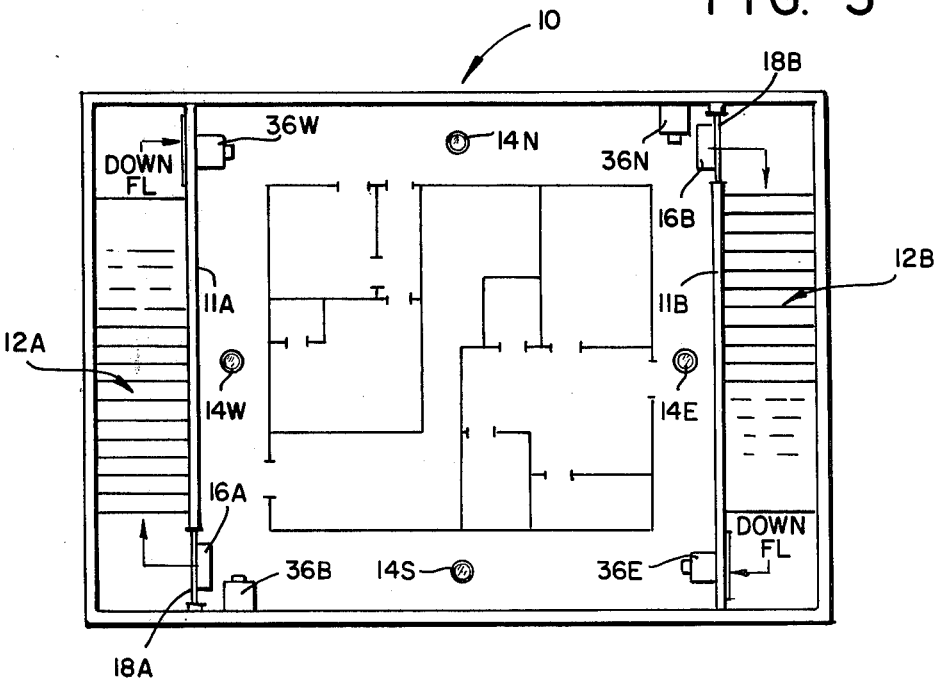
FIG. 3 is a plan view of a typical floor in the building shown in FIG. 1.

Referring to the drawings and in particular to FIGS. 1 and 3 thereof, a multi-storied building 10 is shown having parallel stairwells 12A and 12B adjacent opposite building walls 11A and 11B respectively on each floor of building 10.

As is characteristic of most modern buildings, each floor is provided with fire and/or smoke detectors which are usually located in the ceiling of each story. For purposes of illustrating the principles of the present invention, four of such detectors are shown in FIG. 3 respectively located on the north, south, east and west areas of the floor and are respectively designated 14N, 14S, 14E and 14W. It is to be understood that, in practice, more than four such fire and/or smoke detectors are often employed and may be distributed in a pattern other than that shown in FIG. 3, depending on the floor area and number of rooms under surveillance, however, only four such detectors are shown and described herein for the sake of simplicity in describing the present invention.

Further, in the interests of simplifying the following description of the present invention, building 10 is shown as comprising 10 floors, FL-1, FL-2, ...FL-10, in addition to the ground i.e. lobby foor, FL-G, although as will be apparent from the following discussion, the apparatus of the present invention is applicable for use in buildings having any number of floors.

In accordance with the principles of the present invention, fire exiting signalling units 16A and 16B are respectively affixed to building walls 11A and 11B just above emergency exit doors 18A and 18B on each of floors FL-1, FL-2, FL-3, etc.

Figure 2:
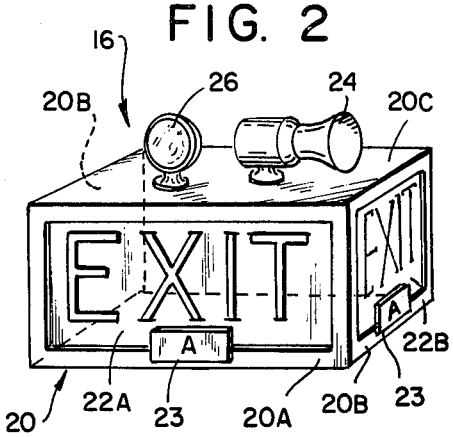
FIG. 2 is a perspective view of an emergency signalling unit in accordance with the present invention.

Each of the fire exit signalling units 16, shown in FIG. 2, comprises a rectangular housing 20 having a light-transparent EXIT sign 22A mounted on the front wall 20A, and EXIT signs 22B (only one shown) mounted on the housing sidewalls 20B respectively. A conventional light source such as an incandescent lamp (not shown) may be mounted within housing 20 so that EXIT signs 22A and 22B are continuously illuminated (customarily in the color red).

Sidewall EXIT signs 22B are provided in order to ensure visibility of the EXIT signs to the building occupants even when they are located close to the building sidewalls 11A and 11B since in the case of smoke-filled rooms and corridors when visibility is impaired, persons tend to proceed close to the building walls when finding their way out of the building.

Fire signalling unit is further provided with a sound transmitter such as a horn 24 rotatably mounted on housing top wall 20C. Horn 24, when actuated, is operative to emit a coded audible signal such as pulsed bleeps. Unit 16 is also provided with a spot lamp 26 rotatably mounted on housing top wall 20C, which, when actuated, emits a pulsed yellow light.

As previously indicated, each floor is provided with a signalling unit 16 overhead each emergency exit door 18A and 18B. It is understood that in the event of a fire, smoke usually quickly fills the rooms and corridors thus impairing the occupants' visibility who are trying to locate the fire exit signs and navigate their way to emergency exit doors 18A and 18B. Furthermore, if, for example, the fire conditions are more severe at the south and west areas of the floor, it is essential that the occupants leave through exit door 18A rather than exit door 18B.

Ordinarily, however, if the occupants' visibility is impaired due to smoke conditions and the attendant emotional stress, the occupants are likely to be unable to find the proper exit, i.e. exit door 18B and may mistakenly head toward exit door 18A. Accordingly, horn 24 for signalling unit 16A is operative to emit an audio signal which is audibly distinguishable from that emitted from horn 24 on signalling unit 16B. Thus, by way example only, horn 24 on unit 16A may emit a high-pitched tone whereas the pulsed tones emitted by horn 24 on unit 16B may be low-pitched. It is understood that the tones respectively emitted by the horns 24 of units 16A and 16B may be made distinguishable from each other in a manner other than that just described. For example, the tone from horn 24 on unit 16A may be continuous while that from unit 16B may be pulsed, i.e. intermittent.

Futhermore, the distinctive sounds emitted by the respective horns 24 on units 16A and 16B may be relied upon by the occupant for identification of the respective units 16A and 16B and the corresponding exit doors 18A and 18B. Thus, for example, horn 24 on unit 16A may emit a single beep in each cycle and that of unit 16B to emit double beeps in each cycle. Accordingly, if the occupants hear single intermittent beeps they will know that such signal originates from exit door 18A and will be directed thereto and if they hear double intermittent beeps they will head toward exit door 18B. Furthermore, the occupants can by comparing the relative loudness of the respective signalling unit signals determine which exit door emitting such signals is closest. Of course, many other means of varying the characteristics of the sounds from horns 24 on units 16A and 16B respectively will be apparent, the essential point being that the occupants may, by listening to the horns sounds distinguish therebetween. In this way, even though their visibility is impaired, the floor occupants can be directed by the appropriate signalling unit 16 to the proper emergency exit door. As shown in FIG. 3 and 23 signalling units 16A and 16B may respectively be labeled as the "A" and "B" units so that the occupants will know which of exit doors 18A and 18B to proceed to in the circumstances just described.

As a further aid in finding the proper exit door, spot lamp 26, when actuated, is operative to emit yellow colored light flashes which may, even under some smoke conditions be at least partially visible to the floor occupants. Furthermore, these light flashes may be coded, as described hereinabove with respect to horns 24 in order to facilitate location of the proper exit door by the building occupants.

Further, in accordance with the present invention, television cameras 36E, 36W, 36N and 36S may be located at the four corners of each building floor for selectively observing the four corridors to which they are respectively directed, as will hereinafter be described in greater detail.

Figure 4:
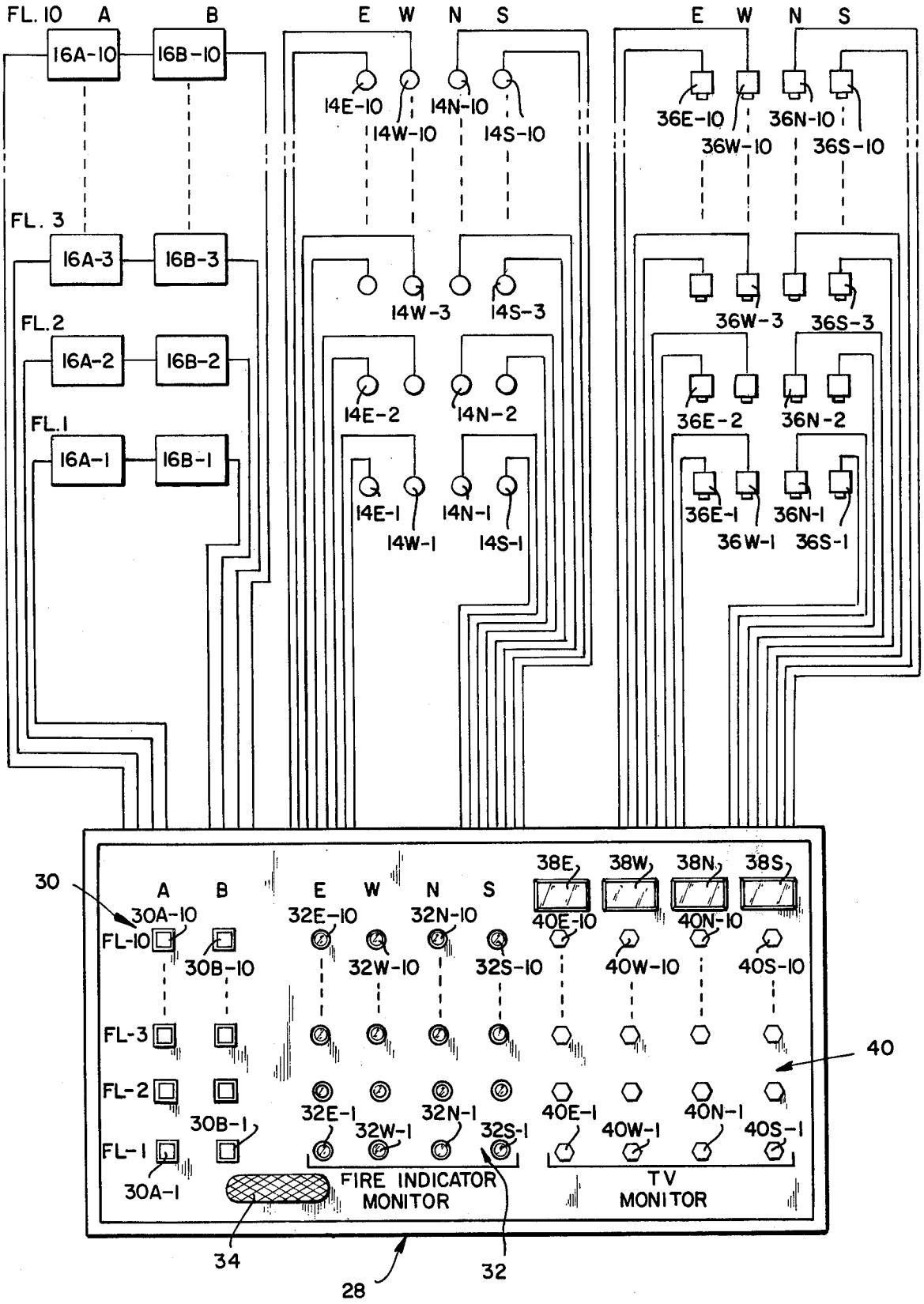
FIG. 4 is a schematic diagram showing the detection and evacuation system of the present invention.

Referring to FIG. 4, a control panel 28 is located on the ground floor FL-G, i.e. lobby of the building 10. Control panel 28 comprises A and B columns of lighted push button switches 30 which are respectively electrically connected to the corresponding signalling units 16 on each floor.

Accordingly, lighted push button switch 30A-1 is connected to signalling unit 16A-1 which is the unit adjacent emergency exit door 18A on the first floor FL-1, and push button switch 30A-2 is connected to signalling unit 16B-1 which is the signalling unit adjacent emergency exit door 18B on the first floor. The remaining lighted push button switches 30A-2, 30B-2, etc. and signalling units 16A-2, 16B-2, etc. are correspondingly identified.

Thus, the fire/smoke detectors 14 on the first floor are identified as 14E-1, 14W-1, 14N-1 and 14S-1 and those on the second floor as 14E-2, 14W-2, 14N-2 and 14S-2, etc.

Control panel 28 further comprises four columns E, W, N, and S of lighted indicators 32 which are respectively electrically connected to the fire/smoke detectors 14 on the various floors. Thus, indicators 32E-1, 32W-1, 32N-1 and 32S-1 are respectively connected to detectors 14E-1, 14W-1, 14N-1 and 14S-1 on the first floor FL-1, indicators 32E-2, 32W-2, 32N-2 and 32S-2 respectively connected to detectors 14E-2, 14W-2, 14N-2 and 14S-2 on the second floor, etc.

In operation, for example, if detector 14E-1 detects a fire and/or smoke condition, the corresponding indicator 32, i.e. 32E-1 will light up and so forth.

Under normal conditions, push button switches 30 will be undepressed and unlit and indicators 32 will also be unlit. However, depression of a push button switch 30 will cause it to light up and will actuate the corresponding horn 24 to emit its characteristic audible signal and spot lamp 26 to flash, as previously described.

Control panel 28 also includes television monitor screens 38E, 38W, 38N and 38S which may respectively connected in closed circuit with television cameras 36E, 36W, 36N and 36S respectively by selective actuation of lighted push button switches 40. Thus, for example, if the lobby attendant wishes to monitor television camera 36W on the 10th floor, he will depress push button switch 36W-10.

Control panel 28 is further provided with a speaker 34 which is operative to emit an alarm siren whenever any one of indicators 32 lights up.

Assume, for example, that a fire/smoke condition exists on the third floor FL-3 in the area of detectors 14S-3 and/or 14W-3, thus causing indicator 32S-3 and/or indicator 32W-3 to light up and speaker 34 to emit an alarm siren thereby alerting the lobby attendant. Since actuation of indicator 32S-3 and 32W-3 indicates a smoke/fire condition in the vicinity thereof, he may depress push button switch 30A-3 causing signalling unit 16A-3 to emit its identifying audio signal and yellow light flashes thus directing the occupants of floor Fl-3 to emergency exit door 18A-3. In addition, if deemed necessary, the attendant may also depress push button switches 30A-1, 30A-2, . . . 30A-10 to completely evacuate the building or selected floors as the circumstances warrant. FL-3

In addition, the attendant before depressing the appropriate signalling unit switch 30, may visually monitor the appropriate television cameras 36E, 36W, 36N and 36S to obtain visual information as to the fire and/or smoke condition in the various corridors of a particular floor and based on the information thus obtained as well as that from the lighted indicators 32 then deciding on the appropriate exit door to be used for evacuation purposes.

Thus, by observing the particular indicators 32 which light up and monitoring the television cameras 36E, 36W, 36N and 36S the attendant can quickly determine the location of the fire/smoke condition and can then effect prompt evacuation of the appropriate building areas by depressing the appropriate push button switches 30. Furthermore, since push button switches 30 light up when depressed, the attendant knows exactly which signalling units 16 are emitting their evacuation signals. Accordingly, as additional indicators 32 light up indicating spreading of the fire/smoke condition, he may decide to deactuate certain switches 30 and/or actuate other switches 30 as the circumstances warrant.

Figure 6:
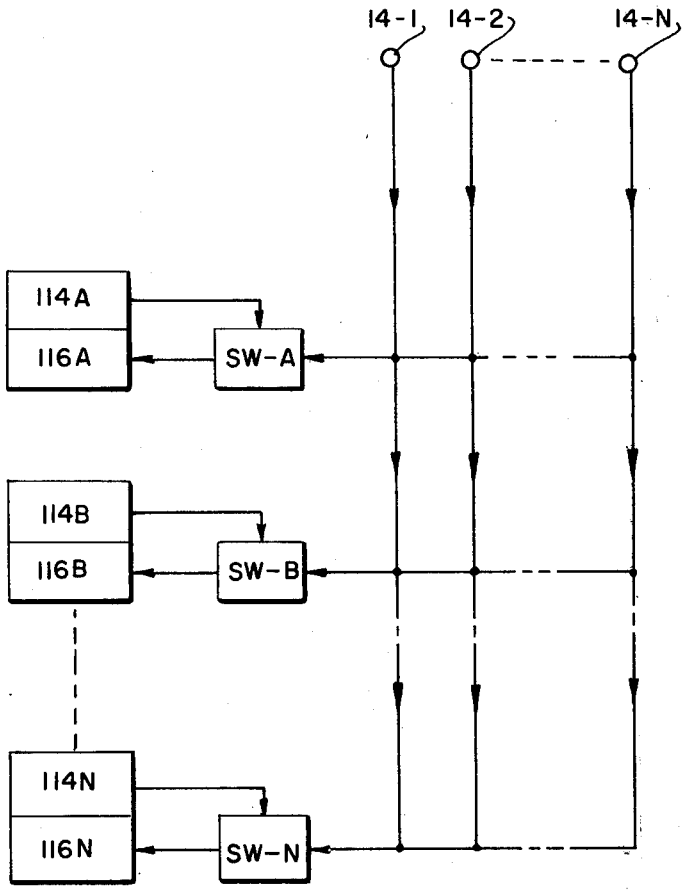
FIG. 6 is an electrical schematic diagram of detection, alarm and evacuation system in accordance with the principles of the present invention in another embodiment thereof.

It is understood that although the system of the present invention has been described hereinabove with respect to the use thereof in a multi-storied building, the basic principles of the system may be employed in a single-storied building, such as in a large auditorium, meeting hall, dance hall, night club, and the like, as shown in FIG. 6.

Referring to FIG. 6, a plurality of fire indicators 14-1, 14-2, . . . 14-10 which may be spatially distributed in the ceiling of such auditorium are operative to detect the occurrence of a fire condition in the vicinity thereof. Emergency exit signalling units 116A, 116B . . . 116N are respectively located overhead the various exits (not shown) in the auditorium and are similar in construction and operation to signalling units 16 described hereinabove except that each of signalling units 116A, 116B, etc. has associated therewith its own fire/smoke detector 114A, 114B, etc. which may be respectively located directly on or in close proximity with its associated signalling unit 116A, 116B, etc.

In addition, signalling units 116A, 116B etc. have associated therewith normally closed switches SW-A, SW-B, etc. which may advantageously be located within the housing of the signalling unit. As shown in FIG. 6, each fire detector 14-1, 14-2, . . . 14-10 is respectively connected to all switches SW-A, SW-B, etc. and each of fire detectors 114A, 114B, etc. is respectively connected to its associated switch SW-A, SW-B, etc.

In operation, detection of a fire condition by any one of the detectors 14-1, 14-2, etc. will cause actuation of all signaling units 116A, 116B, etc. through their normally closed switches SW-A, SW-B, etc. However, if, for example, fire detector 114A detects a fire/smoke condition in the vicinity thereof, it will produce an output signal which is applied to its associated SW-A causing the latter to open and thereby prevent the actuation of signalling unit 116 notwithstanding the actuation of any or all of fire indicators 14-1, 14-2, . . . 14-10. Thus, if there is a fire condition in any part of the auditorium, all the signalling units 116A, 116B, would ordinarily emit their evacuation signals. However, if for example, there is a fire condition in the vicinity of the emergency exit door, the appropriate fire detector 114 will be actuated causing its associated switch SW to open and thus prevent actuation of the associated signalling unit 116. In this way, the occupants will be directed to evacuate the auditorium only through safe exit doors.

Referring to FIGS. 5A and 5B, as a further aid in effecting prompt evacuation of the building 10, a retractable chute 50 may be provided alongside the stairway 12 whereby the occupants may slide down chute 50 rather than walking down the stairs 13. Chute 50 may be advantageously made of a lightweight, sturdy and fireproof material such as aluminum, fiberglass or the like and is provided with a pair of hinges 52 and a simple latch 54 for securing chute 50 to the building sidewall 15.

Thus, in the retracted inoperative position shown in FIG. 5A, chute 50 is maintained in an upright position against sidewall 15. When the building occupants leave via emergency exit door 18 they may release latch 54 whereby chute 50 will be pivoted about hinges 52 until it is supported by stairs 13 in the operative position shown in FIG. 5B. Chute 50 may be suitably curved and dimensioned both in width and length so that the occupants may simply slide down the chute 50 in the direction of arrow 56 and arrive on the landing 58 facing the direction of the next set of stairs 13 as indicated by arrow 56 and shown in FIG. 5B, and if necessary make use of safety rail 57.

Although the invention has been described with reference to a particular embodiment thereof, it is to be understood that this embodiment is merely illustrative of the application of the principles of the invention. Numerous modifications may be made therein and other arrangements may be devised without departing from the spirit and scope of the invention.

What is claimed is:

1. An emergency detection and evacuation system for a building having a plurality of stories comprising, a plurality of detectors spatially distributed on each of said stories operative to detect an emergency condition; a plurality of emergency signalling units respectively located adjacent emergency exits; and a control panel comprising a plurality of indicators respectively connected to said emergency condition detectors an a plurality of signalling switches respectively connected to said signalling units for selectively actuating and deactuating said signalling units in response to said detectors; said signalling units being respectively operative in response to the actuation of respectively associated switches to emit coded audible signals with each of said emitted audible signals being uniquely coded to distinguish each of said coded audible signals from all other of said coded audible signals, said detectors operative to respectively actuate the corresponding panel indicators upon the occurrence of an emergency condition in the vicinity of a detector and means for manually actuating and deactuating selected signalling units in response to the observation by an operator of the actuation and non-actuation of particular panel indicators on said control panel.

2. An emergency detection and evacuation system as defined in claim 1 wherein each of said signalling units is operative in response to the actuation of the corresponding one of said switches to emit a visual signal.

3. An emergency detection and evacuation system as defined in claim 2 wherein said visual signal is emitted simultaneously with said audible signal.

4. An emergency detection and evacuation system as defined in claim 1 including at least one television camera located on each floor of said building structure.

5. An emergency detection and evacuation system as defined in claim 4 wherein said control panel comprises a plurality of television monitor screens respectively connected to said television cameras and a plurality of television switches for selectively connecting said television screens to corresponding television cameras.

6. An emergency detection and evacuation system as defined in claim 1 wherein each of said detectors is operative to detect a fire condition in the vicinity thereof.

7. An emergency detection and evacuation system as defined in claim 1 wherein each of said detectors is operative to detect a smoke condition in the vicinity thereof.

* * * * *